US011976489B2

(12) United States Patent
Shen

(10) Patent No.: US 11,976,489 B2
(45) Date of Patent: May 7, 2024

(54) HEIGHT ADJUSTABLE AND DETACHABLE FENCE SYSTEM

(71) Applicant: Long Xiang Shen, San Bernardino, CA (US)

(72) Inventor: Long Xiang Shen, San Bernardino, CA (US)

( * ) Notice: Subject to any disclaimer, the term of this patent is extended or adjusted under 35 U.S.C. 154(b) by 0 days.

(21) Appl. No.: 18/198,719

(22) Filed: May 17, 2023

(65) Prior Publication Data

US 2023/0287704 A1 Sep. 14, 2023

(51) Int. Cl.
*E04H 17/14* (2006.01)

(52) U.S. Cl.
CPC ..... *E04H 17/1448* (2021.01); *E04H 17/1426* (2013.01)

(58) Field of Classification Search
CPC ..... E04H 17/1413; E04H 17/1417; E04H 17/1426; E04H 17/143; E04H 17/1439; E04H 17/1447; E04H 17/1448; E04H 17/1456; E04H 17/1465; E04H 17/1486; E04H 17/20
USPC ..... 256/22, 65.02, 65.14, 67, DIG. 2
See application file for complete search history.

(56) References Cited

U.S. PATENT DOCUMENTS

| | | | | | |
|---|---|---|---|---|---|
| 344,211 | A * | 6/1886 | Stentz | E04H 17/1486 | 256/46 |
| 4,357,000 | A * | 11/1982 | Tisbo | E04H 17/1426 | 256/22 |
| 5,611,523 | A * | 3/1997 | Parisien | E04H 17/1447 | 256/65.11 |
| 5,695,174 | A * | 12/1997 | Tsai | E04H 17/143 | 256/22 |
| 7,100,904 | B2 * | 9/2006 | Kim | E04H 17/143 | 256/22 |
| 10,631,630 | B2 | 4/2020 | Swartz et al. | | |
| 11,105,114 | B2 * | 8/2021 | Presti | E04H 17/1417 | |
| 11,598,118 | B2 * | 3/2023 | Afshari | E04H 17/1448 | |

FOREIGN PATENT DOCUMENTS

| | | | | |
|---|---|---|---|---|
| CA | 2820331 C | * | 11/2017 | E04H 17/143 |
| DE | 4424304 A1 | * | 1/1996 | E04H 17/1417 |
| EP | 1002910 A2 | * | 5/2000 | E04H 17/16 |
| FR | 2621639 A1 | * | 4/1989 | E04H 17/143 |
| FR | 2886328 A1 | * | 12/2006 | E04H 17/165 |
| FR | 3032003 B1 | * | 1/2017 | E04H 17/1413 |
| WO | WO-0120106 A1 | * | 3/2001 | E04H 17/1413 |

* cited by examiner

*Primary Examiner* — Josh Skroupa
(74) *Attorney, Agent, or Firm* — Che-Yang Chen; Law Office of Michael Chen

(57) ABSTRACT

A height-adjustable and detachable fence system includes a plurality of fence sections pivotally coupled with each other; and a plurality of height adjustable units detachably coupled to the fence sections; wherein the fence section includes at least one horizontal rail, and a plurality of picket members uprightly coupled on the horizontal rail; wherein the height adjustable unit includes a base body supported on a ground and a post body detachably connected to the base body.

15 Claims, 10 Drawing Sheets

HEIGHT ADJUSTABLE AND DETACHABLE FENCE SYSTEM

FIELD OF THE DISCLOSURE

The present disclosure relates to a fence system, and more particularly to a height adjustable and detachable fence system which is suitable for a wide scope of applications. It is particularly suitable for a fence system with a detachable configuration and a height adjustable mechanism to adjust the total height of the fence system selectively.

BACKGROUND OF THE DISCLOSURE

Generally, modular fence systems are becoming increasingly popular with homeowners and businesses alike. Vinyl polymeric fence components have been designed for use in assembling an attractive fence.

However, the prior art modular fence systems are characterized by a number of disadvantages. For example, while a property owner may use a fence to establish property boundaries, alert outsiders to where the periphery of the property is located. Typically, the fence systems are at least 4 to 6 feet tall. Mostly, the height of the fence system may be affixed and cannot be adjusted.

The other disadvantages are that some systems require the laborious and time consuming practice of fastening the fence components with nuts and bolts or other fastening devices. Some of the more decorative-oriented fence systems utilize a lower fence rail to support substantially the entire weight of the planks of the fence, a design that requires a higher frequency of intermittent support posts to inhibit sagging in the lower fence rail.

Furthermore, it would be beneficial to provide such a portable fence system incorporating components enabling an individual to quickly and easily releasably attach two or more modular units to one another depending upon the needs and desires of the individual. Thus, the fencing system may be durable and detachable, and it is easier to adjust the total height of the fence system. Additionally, there is a need for a fencing system that is low maintenance.

All referenced patents, applications, and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, the height-adjustable and detachable fence system may further comprise a plurality of fence sections pivotally coupled with each other; and a plurality of height adjustable units detachably coupled to the fence sections; wherein the fence section comprises at least one horizontal rail and a plurality of picket members uprightly coupled on the horizontal rail; wherein the height adjustable unit comprises a base body supported on a ground and a post body detachably connected to the base body.

In another aspect combinable with the general implementation, the height-adjustable and detachable fence system may further comprise a plurality of connection assemblies arranged on free ends of the horizontal rails and configured to connect each of the fence sections.

Accordingly, the present disclosure is directed toward the height-adjustable and detachable fence system which may further comprise a plurality of connection assemblies which comprise a first protrusion pivotally connected a third protrusion, wherein the first protrusion is formed on one of the fence sections (a first fence section) and the third protrusion is formed on the other one of the fence sections (a second fence section).

Among the many possible implementations of the height-adjustable and detachable fence system, the first protrusion is parallelly and integrally extended from one of the fence sections, and the third protrusion is parallelly and integrally extended from the other one of the fence sections.

Further, it is contemplated that the height-adjustable and detachable fence system may further comprise a plurality of connection assemblies comprising a first protrusion overlappedly contacted with a third protrusion and a fourth protrusion, and a second protrusion overlappedly contacted with the fourth protrusion.

In the alternative, the height-adjustable and detachable fence system may further comprise a plurality of connection assemblies, wherein the connection assembly comprises a third protrusion and a fourth protrusion spacedly arranged with respect to the third protrusion to form a first receiving slot and a second receiving slot, and a first protrusion is received inside the first receiving slot, and a second protrusion is received inside the second receiving slot.

It is still further contemplated that the height-adjustable and detachable fence system may further comprise a plurality of connection assemblies, wherein the connection assembly comprises a first protrusion and a second protrusion formed on one of the fence sections, and a third protrusion and a fourth protrusion formed on the other one of the fence sections, wherein the first and second protrusions are pivotally connected to the third and fourth protrusions.

Another aspect of the embodiment, the post body comprises a pair of hollow supporting posts arranged and secured on two opposite sides of the horizontal rail.

In another aspect combinable with the general implementation, the base body comprises a pair of first locking members inserted into a pair of hollow supporting posts of the post body.

In another aspect combinable with the general implementation, the base body comprises a pair of first locking members spacedly arranged with each other to form a retaining cavity, wherein the horizontal rail is received inside the retaining cavity.

In another aspect combinable with the general implementation, the base body comprises a bottom member and a pair of first locking members integrally and uprightly extended from the bottom member.

In another aspect combinable with the general implementation, the fence section comprises a first fence section pivotally connected to a second fence section to be angled at a degree larger than forty-five degrees.

In another aspect combinable with the general implementation, the height adjustable unit comprises a top cap connected to the post body to secure the post body maintain on two opposite sides of the horizontal rail.

In another aspect combinable with the general implementation, the height-adjustable unit comprises a top cap comprising a pair of second locking members inserted into a pair of hollow supporting posts of the post body to secure the pair of the hollow supporting posts on two opposite sides of the horizontal rail.

In another aspect combinable with the general implementation, the height-adjustable unit comprises a top cap comprising a top member and a pair of second locking members integrally and uprightly extended from the top member.

In another aspect combinable with the general implementation, the post body comprises a pair of hollow supporting posts vertically and parallelly arranged on two opposite sides of the horizontal rail.

In another aspect combinable with the general implementation, the at least one horizontal rail comprises a first horizontal rail and a second horizontal rail, wherein the first horizontal rail is affixed on a bottom portion of a hollow supporting post of the post body, and a second horizontal rail is affixed on a middle portion of the hollow supporting post of the post body.

In another aspect combinable with the general implementation, at least one horizontal rails are suspended above the ground and supported on the base body.

In another aspect combinable with the general implementation, the plurality of picket members are vertically coupled on the horizontal rail and are suspended above the ground.

In another aspect combinable with the general implementation, an end portion of the picket member is embedded inside the horizontal rail to connect the picket member with the horizontal rail.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be too precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary or the following detailed description.

It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered limiting unless the claims expressly state otherwise.

Figure 1:
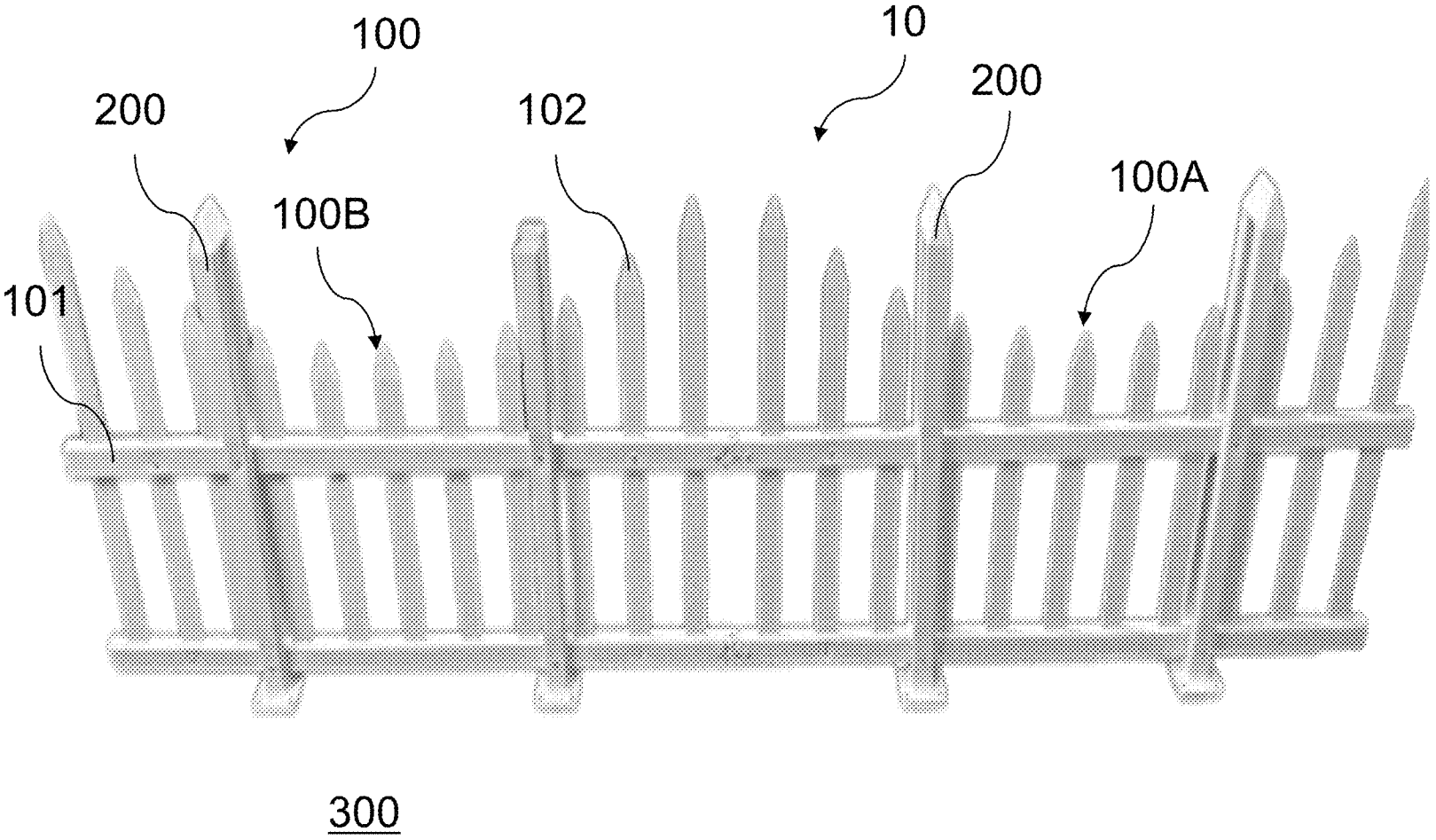
FIG. 1 is a perspective view of a height-adjustable and detachable fence system according to an aspect of the embodiment.

FIG. 1 generally depicts a height-adjustable and detachable fence system 10 according to an aspect of the embodiment.

Referring to FIG. 1, the height-adjustable and detachable fence system 10 may further comprise a plurality of fence sections 100 pivotally coupled with each other. In some embodiments, the plurality of fence sections 100 may comprise a first fence section 100A and a second fence section 100B pivotally coupled with the first fence section 100A. In some embodiments, a predetermined number of fence sections 100 may be utilized to satisfy the specific needs.

In still some embodiments, the height adjustable and detachable fence system 10 may further comprise a plurality of height adjustable units 200 detachably coupled to the fence sections 100, wherein each of the height adjustable units 200 may be spacedly arranged with one another to substantially support the fence sections above a ground 300. In still some embodiments, the fence section 100 may comprise at least one horizontal rail 101 and a plurality of picket members 102 uprightly coupled on the horizontal rail 101. In some embodiments, the plurality of picket members 102 may be vertically arranged and coupled on the horizontal rail 101.

Figure 2:
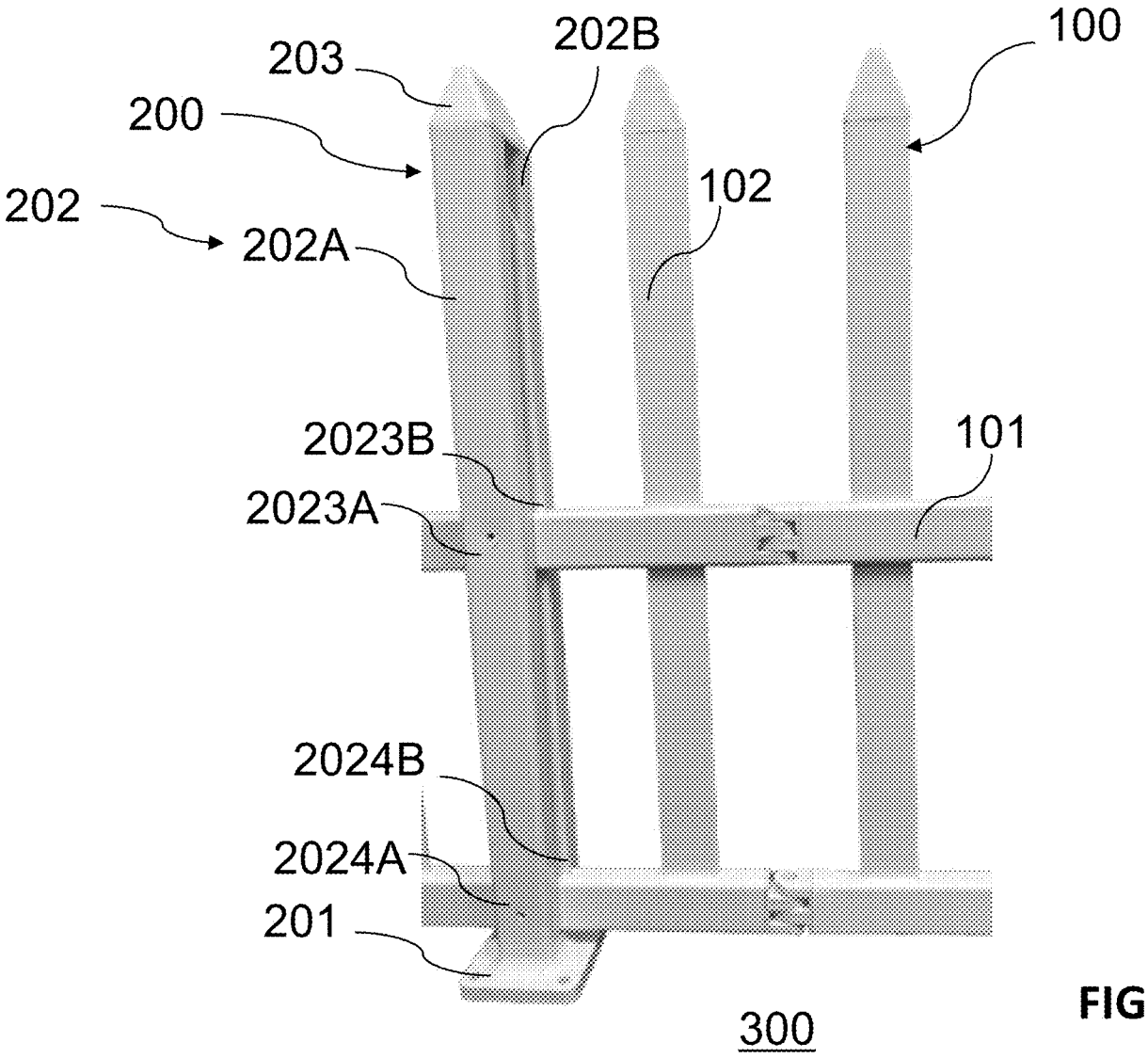
FIG. 2 is a sectional view of the height adjustable unit of the height-adjustable and detachable fence system according to an aspect of the embodiment.

FIG. 2 generally depicts the height adjustable unit 200 of the height-adjustable and detachable fence system according to an aspect of the embodiment.

Referring to FIGS. 2, the height adjustable and detachable fence system may further comprise the plurality of height adjustable units 200 to selectively increase a total height of the fence section 100, wherein the height adjustable unit 200 may further comprise a base body 201, a post body 202 detachably connected to the base body 201, and a top cap 203 detachably connected to the post body 202, wherein the post body 202 may be affixed on the horizontal rail 101.

Referring to further details of FIG. 2, the horizontal rail 101 may be secured on a predetermined location of the post body 202. For example, if the horizontal rail 101 is secured on a higher portion of the post body 202, the total height of the fence section 100 may be higher, and in other words, if the horizontal rail 101 is secured on a lower portion of the post body 202, the total height of the fence section 100 may be lower. In some embodiments, the base body 202 of the height adjustable unit 200 may be supported on the ground 300 and in such a manner, the horizontal rail 101 of the fence section 100 may be supported above the ground 300.

As shown in detail in FIG. 2, the post body 202 comprises a pair of hollow supporting posts 202A, 202B arranged and secured on two opposite sides of the horizontal rail 101, wherein the base body 201 may be located below the horizontal rails 101 and the picket members 102 may be located above the horizontal rails 101. In some embodiments, the pair of the hollow supporting posts 202A, 202B may be parallelly arranged on two opposite sides of the horizontal rail 101.

Figure 3:
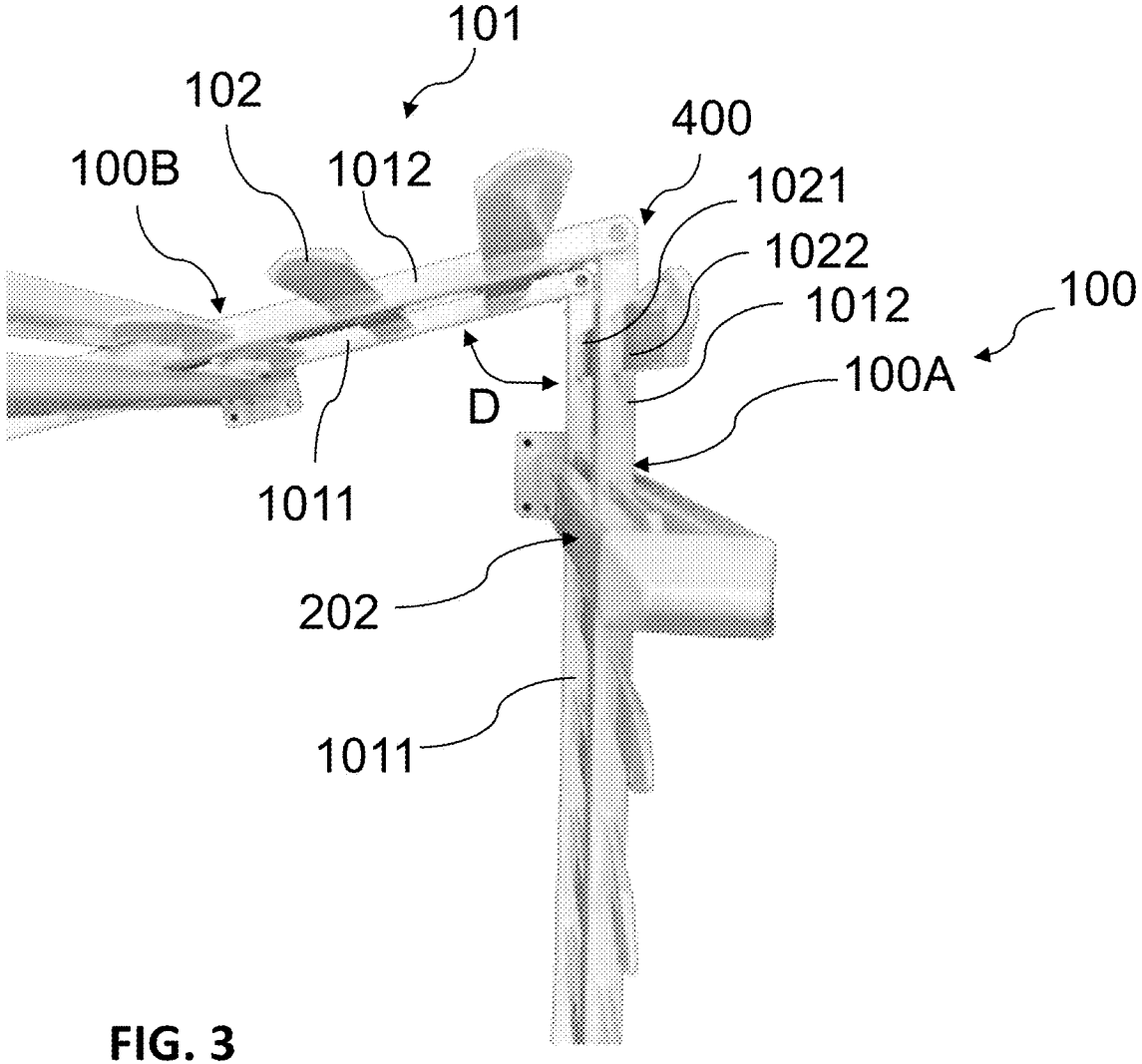
FIG. 3 is a top view of the height-adjustable and detachable fence system showing a first fence section being angled with a second fence section according to an aspect of the embodiment.

FIG. 3 generally depicts that the first fence section 100A is pivotally coupled to the second fence section 100B of the height-adjustable and detachable fence system according to an aspect of the embodiment.

In some embodiments, the height adjustable and detachable fence system may further comprise a plurality of connection assemblies 400, wherein the first fence section 100A may be pivotally coupled to the second fence section 100B by the plurality of connection assemblies 400.

In some embodiments, the connection assembly 400 may be arranged on free ends of the horizontal rail 101 and configured to connect each of the fence sections (the first fence section 100A, the second fence section 100B). For example, the height-adjustable and detachable fence system may comprise a pair of horizontal rails 101, including a first horizontal rail 1011 and a second horizontal rail 1012, wherein the post body 202 may be secured on the first horizontal rail 1011 and/or the second horizontal rail 1012.

In some embodiments, end portions 1021 of the picket members 102 may be embedded inside the first horizontal rail 1011 and middle portions 1022 of the picket members 102 may be passed through the second horizontal rail 1012.

Continuing to FIG. 3, the first fence section 100A and the second fence section 100B may be angled at a predetermined degree "D", and in such a manner, the predetermined degree "D" may be larger than forty-five degrees. It should be noted that the predetermined degree "D" may not be smaller than forty-five degrees based on the configuration of the connection assembly 400.

Figure 4:
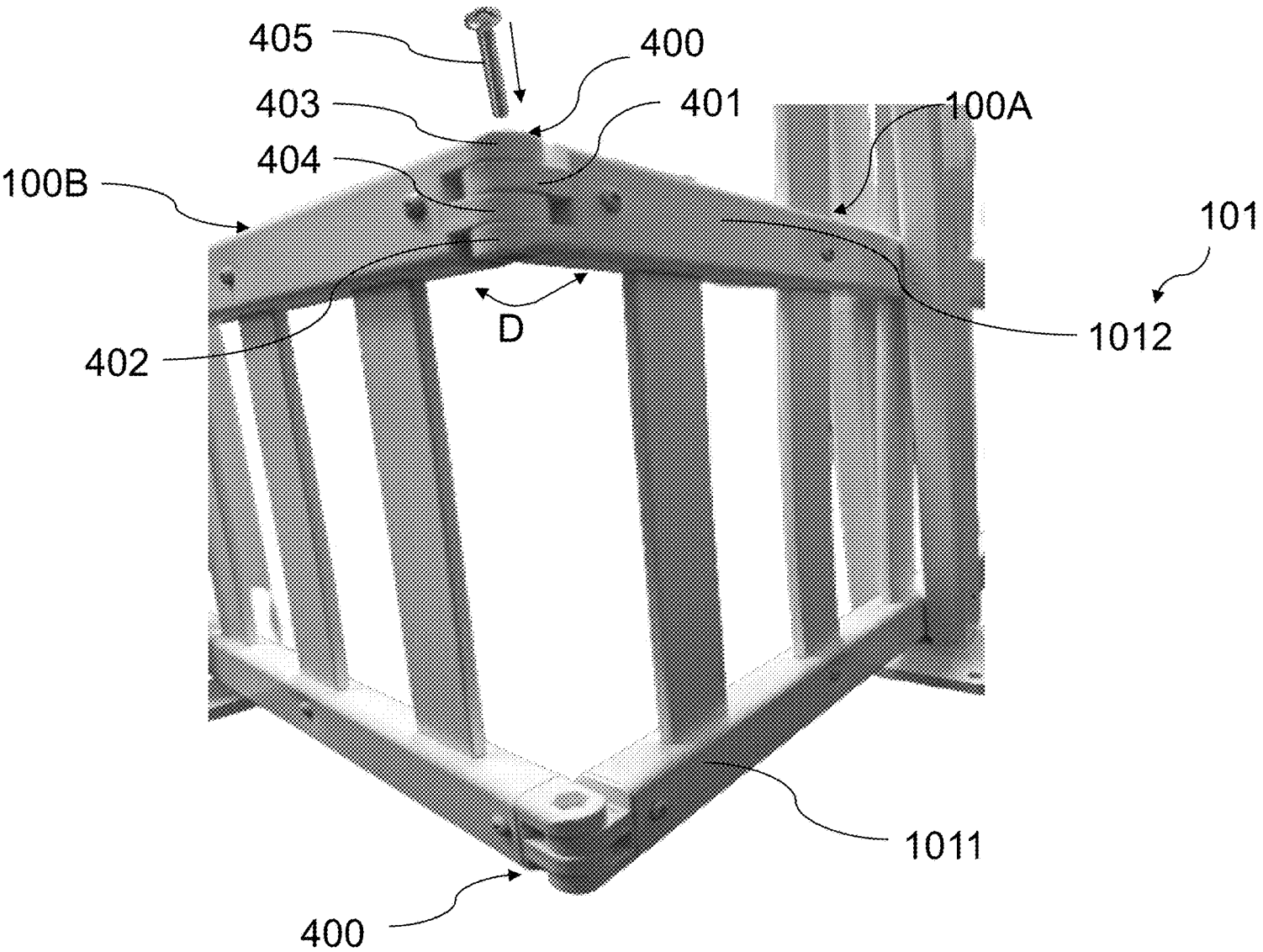
FIGS. 4-5 are perspective views of a connection assembly of the height-adjustable and detachable fence system according to an aspect of the embodiment.
Figure 5:
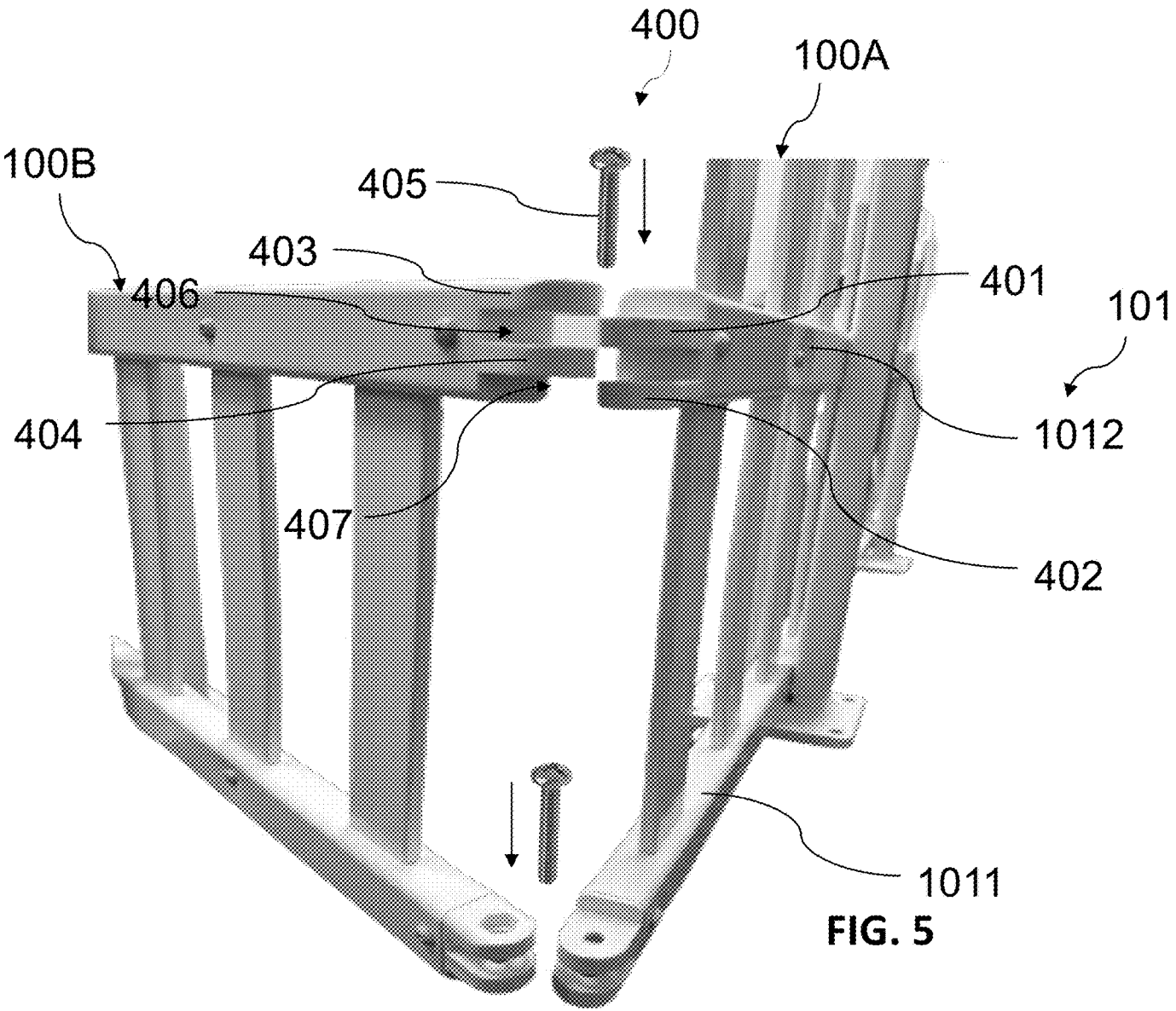

FIGS. 4-5 generally depict the connection assembly of the height-adjustable and detachable fence system according to an aspect of the embodiment.

Referring to FIG. 4, the connection assembly 400 may comprise a first protrusion 401 pivotally connected a third protrusion 403, wherein the first protrusion 401 is formed on the first fence section 100A and the third protrusion 403 is formed on the second fence section 100B. In some embodiments, the first protrusion 401 is pivotally coupled to the third protrusion 403 via a fastener 405. In some embodiments, the first protrusion 401 may be overlappedly contacted with the third protrusion 403.

In still some embodiments, the connection assembly 400 may further comprise the second protrusion 402 formed on the first fence section 100A and a fourth protrusion 404 formed on the second fence section 100B, wherein the second protrusion 402 may be overlappedly contacted with the fourth protrusion 404.

In still some embodiments, the first protrusion 401 may be overlappedly contacted with the third protrusion 403 and the fourth protrusion 404, and the second protrusion 402 may be overlappedly contacted with the fourth protrusion 404. It should be noted that, in some embodiments, the first protrusion 401 and/or the second protrusion 402 may be parallelly and integrally extended from the horizontal rails 101 (the second horizontal rail 1012/the first horizontal rail 1011) of the first fence section 100A, and the third protrusion 403 and/or the fourth protrusion 404 may be parallelly and integrally extended from the horizontal rails 101 (the second horizontal rail 1012/the first horizontal rail 1011) of the second fence section 100B, and the fastener 405 may be passed through the first protrusion 401, the third protrusion 403, and/or the second protrusion 402, and/or the fourth protrusion 404 to pivotally connect the first fence section 100A with the second fence section 100B, and in such a manner, the first fence section 100A may be angled with the second fence section 100B at a predetermined degree which is larger than forty-five degrees; otherwise, the connection assembly 400 may not function.

Referring to FIG. 5, the third protrusion 403 may be spacedly arranged with respect to the fourth protrusion 404 to form a first receiving slot 406 and a second receiving slot 407, wherein the first protrusion 401 may be received inside the first receiving slot 406 and the second protrusion 402 may be received inside the second receiving slot 407. In some embodiments, the fastener 405 may be passed through the first protrusion 401, the second protrusion 402, the third protrusion 403, and the fourth protrusion 404, and the first protrusion 401, the second protrusion 402, the third protrusion 403, and the fourth protrusion 404 may be pivotally connected.

In some embodiments, the connection assembly 400 may comprise the first protrusion 401 formed on the first fence section 100A, the third protrusion 403 formed on the second fence section 100B, and the fourth protrusion 404 formed on the second fence section 100B, wherein the first protrusion 401, the third protrusion 403, and the fourth protrusion 404 may be pivotally coupled with each other through the fastener 405, and in such a manner, the second protrusion 402 formed on the first fence section 100A is not necessary. Also, in this embodiment, the first protrusion 401 may be parallelly and integrally extended from the horizontal rails 101 (the first horizontal rail 1011/the second horizontal rail 1012) of the first fence section 100A, and the third and fourth protrusions 403, 404 may be parallelly and integrally extended from the horizontal rail 101 (the first horizontal rail 1011/the second horizontal rail 1012) of the second fence section 100B.

Figure 7:
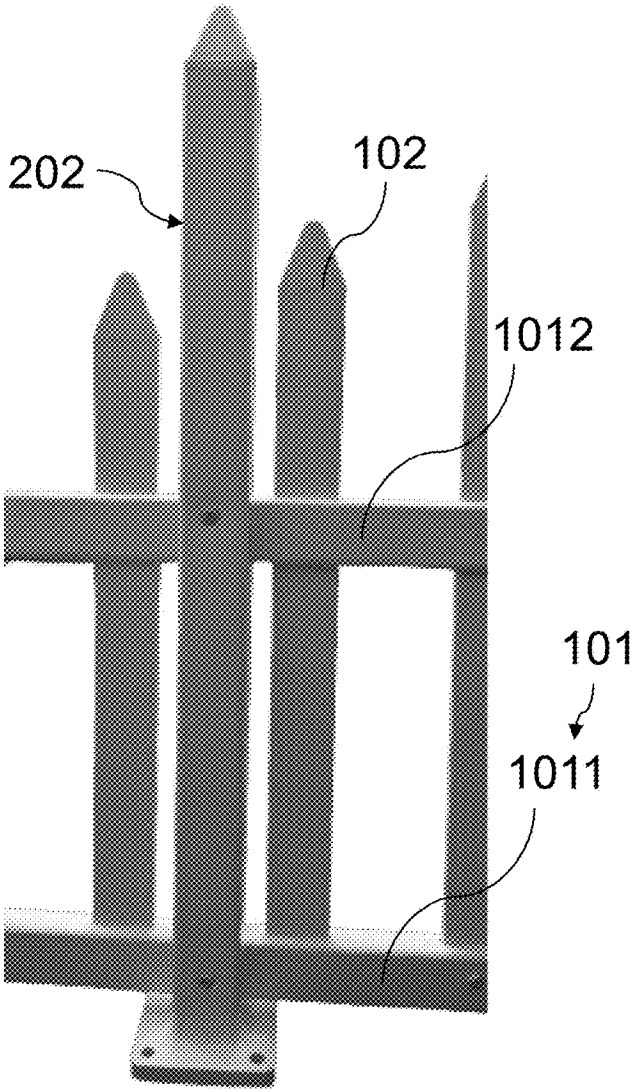
FIG. 7 is a front perspective view showing that the height-adjustable unit is cooperated with the fence section according to an aspect of the embodiment.
Figure 6:
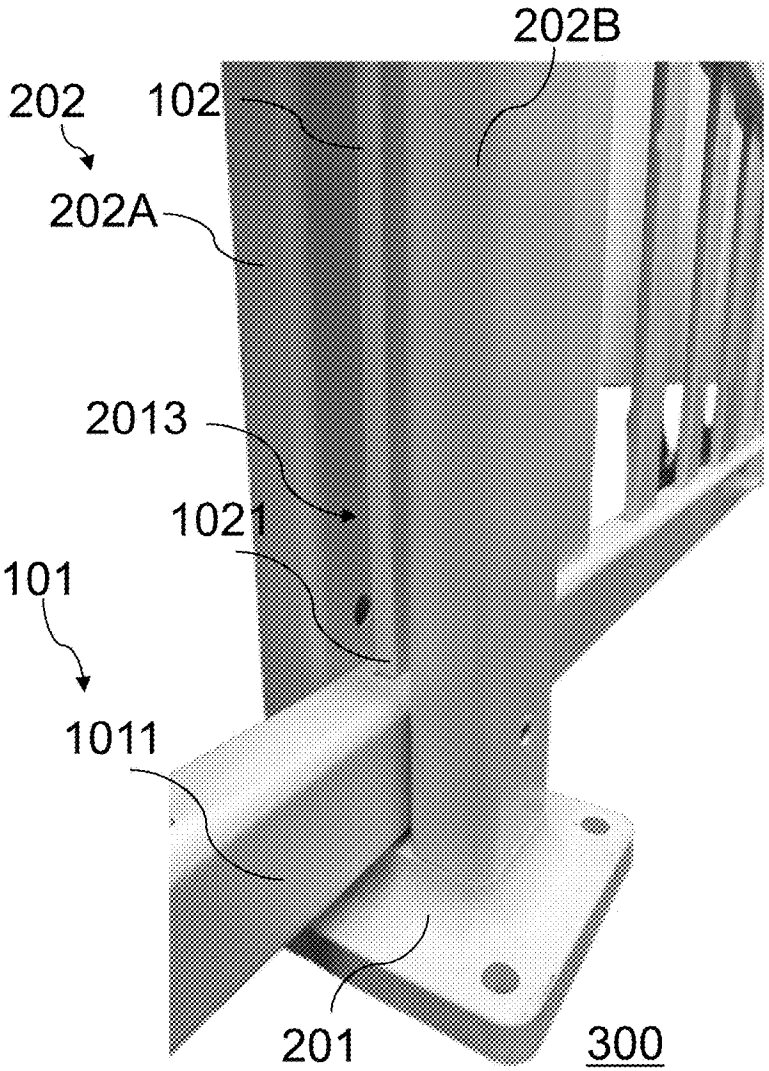
FIG. 6 is a sectional view showing that the height adjustable unit is cooperated with a first horizontal rail of the fence section (the first/second fence section) according to an aspect of the embodiment.

FIGS. 6-7 generally depict that the first horizontal rail 1011 is cooperated with the height-adjustable unit according to an aspect of the embodiment.

Referring to FIG. 6, the horizontal rail 101 (the first horizontal rail 1011/the second horizontal rail 1012) may be suspended above the ground 300 and supported on the base body 201. As shown in further detail in FIG. 6, the plurality of picket members 102 are uprightly/vertically coupled on the first horizontal rail 1011 of the horizontal rail 101 and are suspended above the ground 300. In some embodiments, the picket members 102 may be located between the pair of hollow supporting posts 202A, 202B, wherein the end portion 1021 of the picket member 102 may be embedded inside the first horizontal rail 1011.

Referring to FIG. 7, in some embodiments, the post body 202 may be parallelly arranged with respect to the picket members 102, wherein the post body 202 may comprise a pair of hollow supporting posts 202A, 202B (see FIG. 6), and in such a way, a length of the hollow supporting post 202A, 202B may be utilized to determine the total height of the fence system.

In some embodiments, as shown in further details in FIG. 6 and FIG. 7, the pair of hollow supporting posts may comprise a first hollow supporting post 202A and a second hollow supporting post 202B, wherein the first hollow supporting post 202A and the second hollow supporting post 202B may be vertically and parallelly arranged on two opposite sides of the first horizontal rail 1011. In some embodiments, (referring back to FIG. 2) the first horizontal rail 1011 may be affixed on a bottom portion 2024A of the first hollow supporting post 202A and/or a bottom portion 2024B of the second hollow supporting post 202B of the post body 202 and the second horizontal rail 1012 may be affixed on a middle portion 2023A of the first hollow supporting post 202A of the post body 202 and/or a middle portion 2024B of the second hollow supporting post 202B of the post body 202, and in such a way, the post body 202 of the height adjustable unit may be secured in position without shaking.

Figure 9:
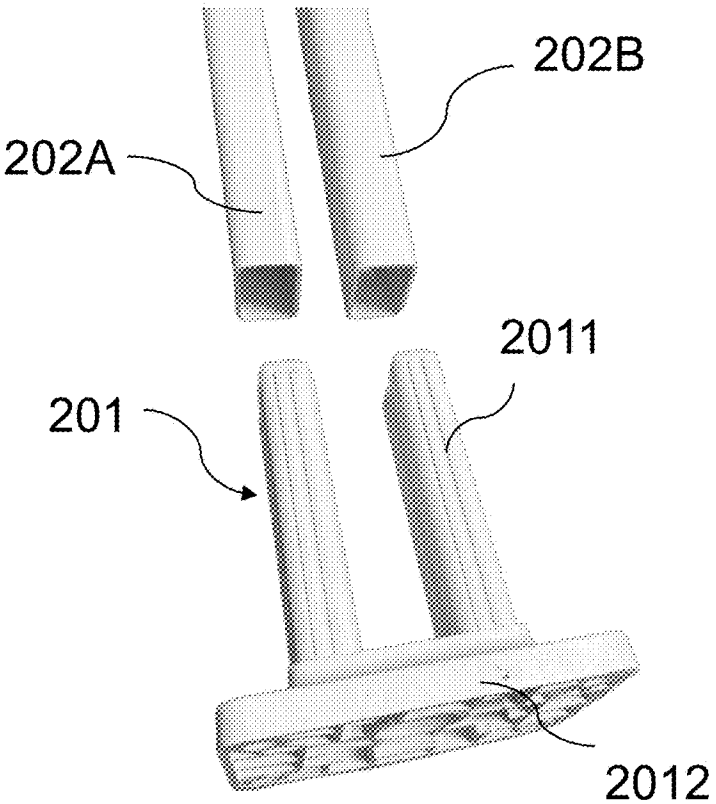
FIG. 9 is a sectional and an exploded view of the height-adjustable unit according to an aspect of the embodiment.
Figure 8:
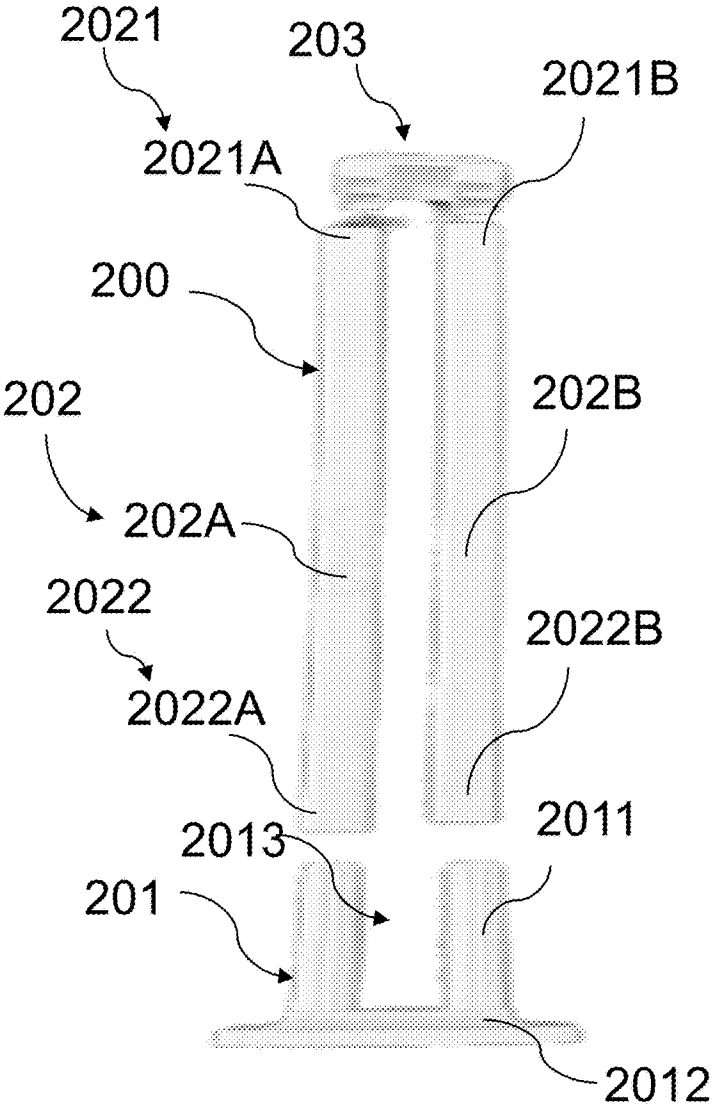
FIG. 8 is an exploded view of the height-adjustable unit according to an aspect of the embodiment.
Figure 10:
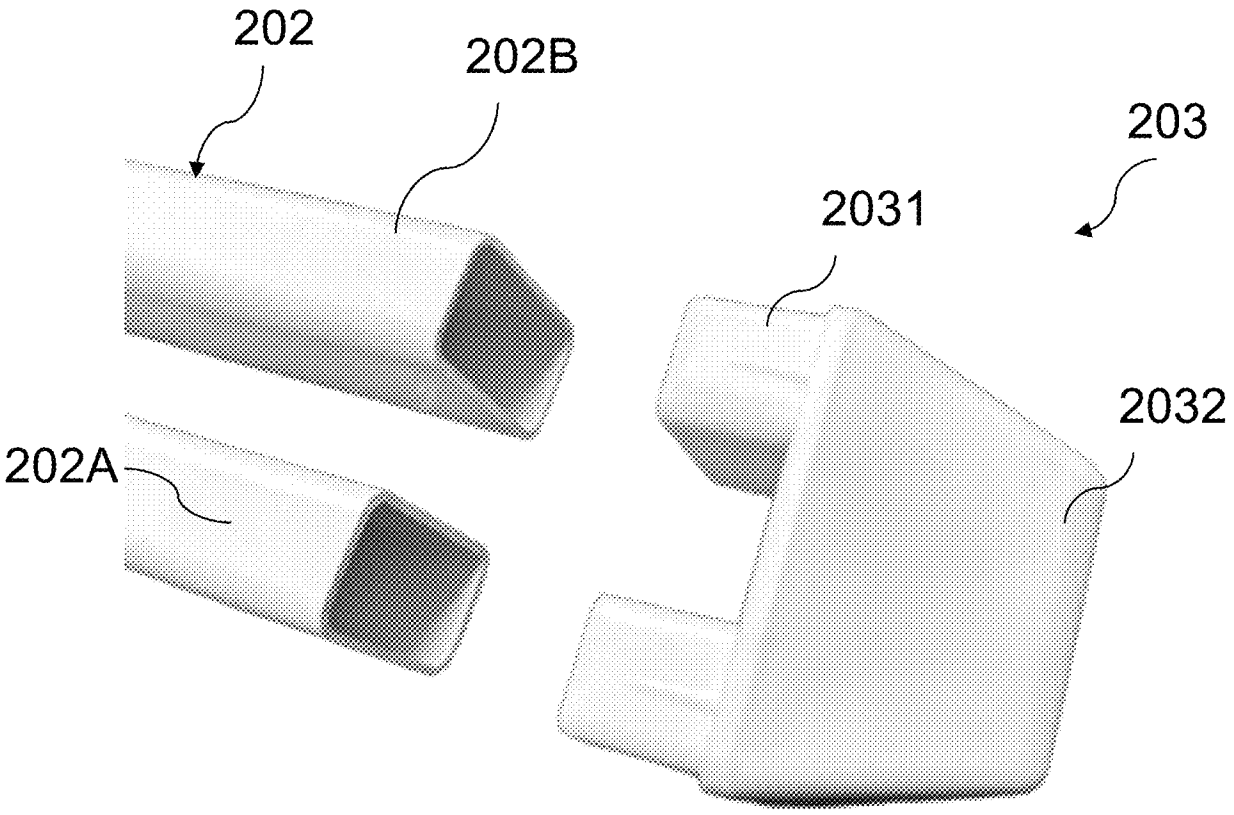
FIG. 10 is a sectional and an exploded view of the height-adjustable unit according to an aspect of the embodiment.

FIGS. 8-10 generally depict the height-adjustable unit 200 according to an aspect of the embodiment.

Referring to FIG. 8, the base body 201 may comprise a pair of first locking members 2011 which may be inserted into a pair of hollow supporting posts 202, including the first hollow supporting post 202A and the second hollow supporting post 202B, of the height-adjustable unit. In some embodiments, the pair of first locking members 2011 may be spacedly arranged with each other to form a retaining cavity 2013, wherein the horizontal rail 101 (the first or second horizontal rail 1011, 1012) may be received inside the retaining cavity 2013 (see FIG. 6 for details).

As shown in FIG. 9, the base body 201 may comprise a bottom member 2012 and the pair of first locking members 2011 integrally and uprightly extended from the bottom member 2012, and in such a manner, a distance between the pair of the first locking members 2011 may be secured.

Referring now to the detail of FIG. 10, the height adjustable unit may further comprise the top cap 203 connected to the pair of the hollow supporting posts 202, including the first hollow supporting post 202A and the second hollow supporting post 202B, to secure the hollow supporting posts 202 on two opposite sides of the horizontal rail 101 (see FIG. 6). In some embodiments, the top cap 203 may comprise a pair of second locking members 2031 which may be inserted into the pair of hollow supporting posts 202A, 202B of the post body 202. In some embodiments, the top cap 203 may further comprise a top member 2032 and the pair of second locking members 2031 integrally and uprightly extended from the top member 2032.

It should be noted that, referring back to FIG. 8, in some embodiments, the top cap 203 may be cooperated with front ends 2021 of the pair of the hollow supporting posts 202 and the base body 203 may be cooperated with bottom ends 2022 of the pair of the hollow supporting posts 202, wherein the front ends 2021 of the hollow supporting posts 202 may be opposite of the bottom ends 2022 of the hollow supporting posts 202.

Accordingly, in some embodiments, the top cap 203 may be cooperated with a front end 2021A of the first hollow supporting post 202A and a front end 2021B of the second hollow supporting post 202B, wherein the base body 203 may be cooperated with a bottom end 2022A of the first hollow supporting post 202A and a bottom end 2022B of the second hollow supporting post 202B, wherein the front end 2021A of the first hollow supporting post 202A may be opposite of the bottom end 2022A of the first hollow supporting post 202A. In still some embodiments, the front end 2021B of the second hollow supporting post 202B may be opposite of the bottom end 2022B of the second hollow supporting post 202B.

Figure 11A:
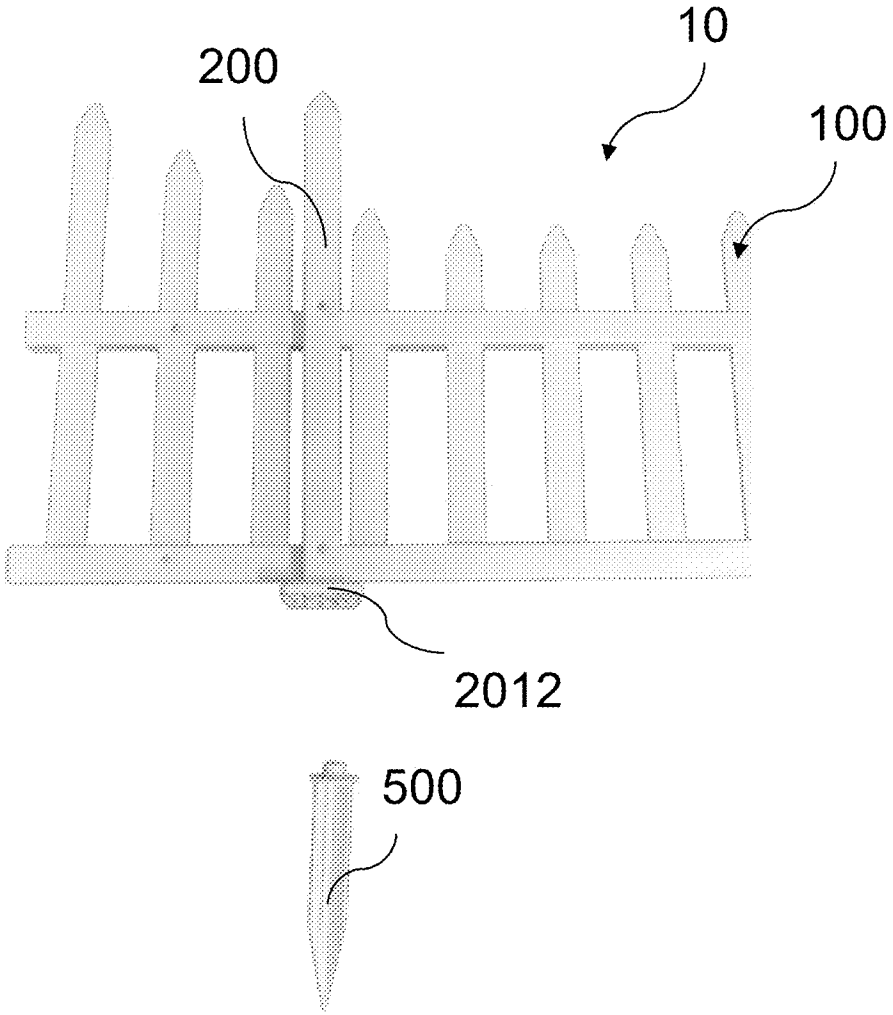
FIG. 11A is a sectional view of a supporting unit of the height-adjustable and detachable fence system according to an aspect of the embodiment.
Figure 11B:
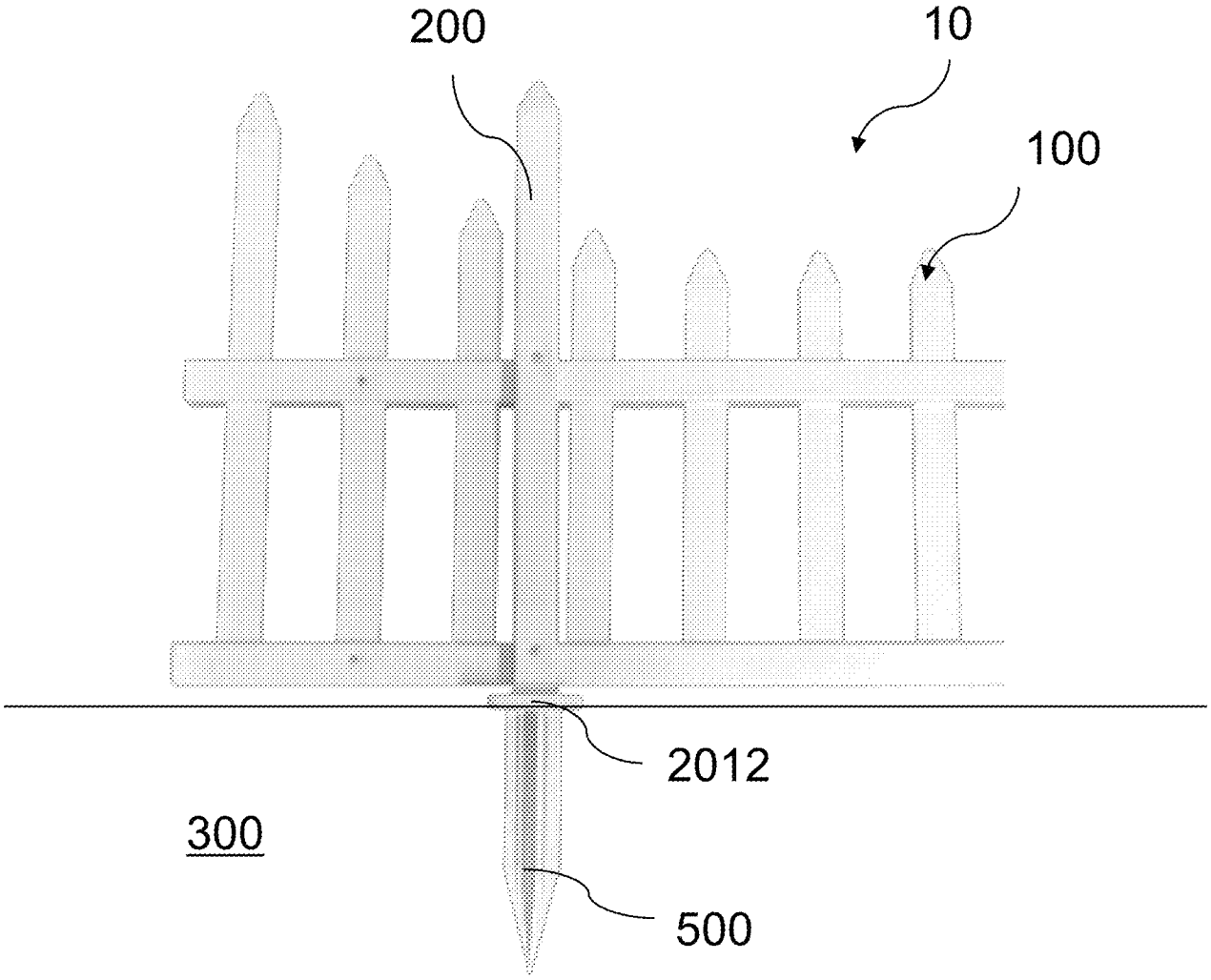
FIG. 11B is a sectional view of the supporting unit cooperating with the height-adjustable unit according to an aspect of the embodiment.

FIGS. 11A to FIG. 11B generally depict a supporting unit of the height-adjustable and detachable fence system according to an aspect of the embodiment.

Referring to FIG. 11A and FIG. 11B, the height-adjustable and detachable fence system 10 may further comprise a plurality of supporting units 500 coupled with the height adjustable units 200 to support the plurality of fence sections 100 on the ground 300.

It should be noted that, in one embodiment, the supporting unit 500 may be detachably coupled with the height adjustable unit 200. In still one embodiment, the supporting unit 500 may be detachably coupled with the bottom member 2012 of the base body of the height adjustable unit 200. Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more or different elements, which are disclosed herein even when not initially claimed in such combinations.

Thus, specific embodiments and applications of the height adjustable and detachable fence system have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings, but to include by special definition in this specification structure, material or acts beyond the scope of the commonly defined meanings. Thus, if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A height-adjustable and detachable fence system, comprising:

a plurality of fence sections having a first fence section and a second fence section pivotally coupled with the first fence section; and a plurality of height adjustable units detachably coupled to the fence sections;

wherein each of the first fence section and the second fence section both comprises at least one horizontal rail, and a plurality of picket members uprightly coupled on the horizontal rail; wherein the height adjustable unit comprises a base body supported on a ground and a post body detachably connected to the base body; wherein the first fence section comprises a first protrusion and a second protrusion pivotally connected a third protrusion and a fourth protrusion formed the second fence section; wherein the post body comprises a pair of hollow supporting posts vertically and parallelly arranged on two opposite sides of the horizontal rail to form a retaining cavity, wherein a picket member of the plurality of picket members is located within the retaining cavity.

2. The height-adjustable and detachable fence system of claim 1, further comprising a plurality of connection assemblies arranged on free ends of the horizontal rails and configured to connect the first fence section with the second fence section.

3. The height-adjustable and detachable fence system of claim 1, wherein the first protrusion is parallelly and integrally extended from a free end of the horizontal rail of the first fence section, and the third protrusion is parallelly and integrally extended from a free end of the horizontal rail of the second fence section.

4. The height-adjustable and detachable fence system of claim 1, wherein the first protrusion is overlappedly contacted with the third protrusion and the fourth protrusion, and the second protrusion is overlappedly contacted with the fourth protrusion.

5. The height-adjustable and detachable fence system of claim 1, wherein the third protrusion and the fourth protrusion are spacedly arranged with respect to the third protrusion to form a first receiving slot and a second receiving slot, and the first protrusion is received inside the first receiving slot and the second protrusion is received inside the second receiving slot.

6. The height-adjustable and detachable fence system of claim 1, wherein the base body comprises a pair of first locking members inserted into a pair of hollow supporting posts of the post body.

7. The height-adjustable and detachable fence system of claim 1, wherein the horizontal rail is received inside the retaining cavity.

8. The height-adjustable and detachable fence system of claim 1, wherein the base body comprises a bottom member and a pair of first locking members integrally and uprightly extended from the bottom member.

9. The height-adjustable and detachable fence system of claim 1, wherein the height adjustable unit comprises a top cap connected to the post body to secure the post body on two opposite sides of the horizontal rail.

10. The height-adjustable and detachable fence system of claim 1, wherein the height-adjustable unit comprises a top cap comprising a pair of second locking members inserted into a pair of hollow supporting posts of the post body to secure the pair of the hollow supporting posts on two opposite side of the horizontal rail.

11. The height-adjustable and detachable fence system of claim 1, wherein the height-adjustable unit comprises a top cap comprising a top member and a pair of second locking members integrally and uprightly extended from the top member.

12. The height-adjustable and detachable fence system of claim 1, wherein the at least one horizontal rail comprises a first horizontal rail and a second horizontal rail, wherein the first horizontal rail is affixed on a bottom portion of the hollow supporting post of the post body and a second horizontal rail is affixed on a middle portion of the hollow supporting post.

13. The height-adjustable and detachable fence system of claim 1, wherein the at least one horizontal rails are suspended above the ground and supported on the base body.

14. The height-adjustable and detachable fence system of claim 1, wherein the plurality of picket members are vertically coupled on the horizontal rails and are suspended above the ground.

15. The height-adjustable and detachable fence system of claim 1, wherein an end portion of the picket member is embedded inside a first horizontal rail of the at least one horizontal rail, and a middle portion of the picket member is passed through a second horizontal rail of the at least one horizontal rail to connect the picket member with the horizontal rail.

* * * * *